United States Patent [19]

Cho et al.

[11] Patent Number: 4,605,877

[45] Date of Patent: Aug. 12, 1986

[54] MOUNTING STRUCTURE FOR MULTI-FILAMENTS OF AN INCANDESCENT LAMP

[75] Inventors: Timothy C. Cho, Mayfield Hts.; Edwin J. Lohrey, Euclid, both of Ohio

[73] Assignee: General Electric Company, Schenectady, N.Y.

[21] Appl. No.: 701,821

[22] Filed: Feb. 14, 1985

[51] Int. Cl.[4] ..... H01J 1/88; H01J 19/42; H01K 1/18

[52] U.S. Cl. ..... 313/272; 313/318; 313/113; 313/316; 313/333; 315/64

[58] Field of Search ..... 313/318, 272, 113, 333, 313/316; 315/64, 67

[56] References Cited

U.S. PATENT DOCUMENTS

| | | | |
|---|---|---|---|
| 4,208,603 | 6/1980 | Graves et al. | 313/316 |
| 4,400,646 | 8/1983 | Lohrey | 313/333 |
| 4,556,822 | 12/1985 | Lohrey et al. | 313/333 |

*Primary Examiner*—Saxfield Chatmon

*Attorney, Agent, or Firm*—John P. McMahon; Philip L. Schlamp; Fred Jacob

[57] ABSTRACT

An improved structure for mounting minor and major filaments of a three-way incandescent lamp is disclosed. The improved mounting structure orients the major filament in either an axial or transverse manner and the minor filament in a transverse manner. The transverse mounting of the major and minor filaments is established by the selection of the respective parameters of the inner lead wires connected to the minor and major filaments so as to improve the ability of each transverse mounted filament to withstand mechanical shock.

6 Claims, 3 Drawing Figures

MOUNTING STRUCTURE FOR MULTI-FILAMENTS OF AN INCANDESCENT LAMP

BACKGROUND OF THE INVENTION

The present invention relates to incandescent lamps having multi-filaments. More particularly, the present invention relates to incandescent lamps having improved structures for transversely mounting minor and major filaments.

Incandescent lamps having multi-filaments are well-known and described as such in U.S. Pat. 3,131,986 of J. G. Edwards, issued May 5, 1964 and which is assigned to the same assignee as the present invention. U.S. Pat. 3,131,986 discloses a three-way incandescent lamp having minor and major filaments and adapted for use in sockets having a switching arrangement for energizing the filaments individually, or both in multiple, so as to obtain three levels of desired illumination.

Further, U.S. patent application Ser. No. 607,838, filed May 7, 1984, which makes reference to U.S. Pat. No 4,400,646 and U.s. Pat. Nos. 4,556,882 and 4,400,646 issued Aug. 23, 1983, discloses a multi-filament incandescent lamp having an improved mounting structure. U.S. Pat. application Ser. No. 607,838 and U.S. Pat. 4,400,646 are both assigned to the same assignee as the present invention and are both herein incorporated by reference.

The mounting arrangement described in U.S. patent application Ser. No. 607,838 has various means for providing a rigid mounting for both the major and minor filaments, each preferably of a coiled-coil type.

The filaments of U.S. patent application No. 607,838 are both mounted in an axial manner which is most beneficial with regard to the light output of the lamp. The axial or vertical mounting of the coiled-coil filaments, commonly termed CC8, by placing the filament lengthwise or axially within the lamp provides for more light output relative to a transverse placement of the filament within the lamp. The transverse or horizontal mounting of the coiled-coil filament, commonly termed CC6, while yielding less light output, relative to the CC8 mounting, is beneficial with regard to the strength of the mounted filament. The CC6 mounting improves the ability of the filament to withstand mechanical shock. This increased ability is especially beneficial to the weaker, low-wattage, minor filaments of the multi-filament incandescent lamp.

The selection between a CC8 or a CC6 mounting should take into account the desired light output and the ability of filaments to withstand shock. It is considered desirable for most applications to mount the major filament in a CC8 configuration so as to provide for the most efficient output of the major light source and to mount the minor filament in a CC6 configuration so as to provide the desired strength for the minor filament.

For other applications, primarily related to the ability of the filament of the lamp to withstand mechanical shock, it is desired to mount both the minor and major filaments in a CC6 configuration.

In all of the above CC6 configurations it is desired that means be provided for improving the transverse mounting of both the minor and major filaments so that each are rigidly disposed within the multi-filament incandescent lamps.

Accordingly, it is an object of the present invention to provide an improved mounting structure for coiled-coil minor and major filaments of a three-way incandescent lamp wherein the major filament may be mounted in an axial or transverse manner and the minor filament may be mounted in a transverse manner and each such transverse mounting has improved characteristics to withstand mechanical shock.

SUMMARY OF THE INVENTION

The present invention is directed to an improved structure of a multi-filament incandescent lamp which provides rigid mounting so as to orient the major filament in either an axial manner or transverse manner and the minor filament in a transverse manner.

The mounting structure comprises a three-pillar portion stem having inner and outer lead wires extending through each of the three pillar portions with one end of each of said outer lead wires appropriately connected to an electrically conductive screw-in base effective to obtain different levels of illumination for the multi-filament incandescent lamp. The inner lead wires have hooked bends for respective clamp connections to each of the minor and major filaments.

In one embodiment the major filament is axially mounted and the minor filament is transversely mounted preferably with a support member about its central portion and which support member is sealed in the three-pillar stem by way of the exhaust tube of the lamp. In another embodiment, both the minor and major filaments are transversely mounted.

In all of the embodiments, the inner lead wires each have a desired configuration. Further, the stability for each of the transversely mounted filaments is provided by predeterminedly selecting a first and a second of the inner lead wires with at least one of the first and second inner lead wires being shorter than the other. The preselection further comprising the first lead wire having an uppermost crimped connection located at a first predetermined distance from the upper portion of the three-pillar stem and a first diameter both selected so as to be proportionate to the location of a second crimped connection located at a second predetermined distance relative the upper portion of the three-pillar stem and a second diameter both of the second inner lead wire in accordance with the following relationship:

$$\text{second diameter} = \text{first diameter} \times \frac{\text{second distance}}{\text{first distance}} \quad \text{(a)}$$

where the quantity (a) has a value in the range of about one-half ($\frac{1}{2}$) to about (1).

Each of the filaments transversely mounted in accordance with the given relationship reduces the typically encountered movement of the minor and major filaments so as to increase the strength of the minor and major filaments to withstand mechanical shock.

The features of this invention believed to be novel are set forth with particularity in the appended claims. The invention itself, however, as regards to a structure and advantages thereof, may be more readily understood with reference to the following description taken in conjunction with the accompanying drawings.

DETAILED DESCRIPTION OF THE PREFERRED EMBODIMENTS

Figure 1:
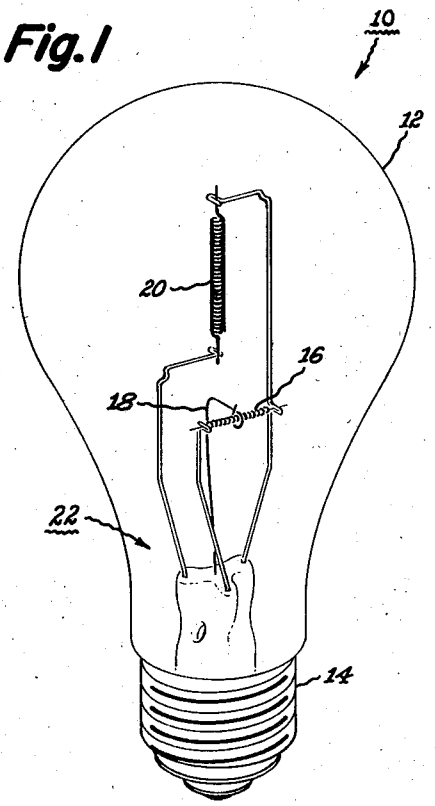
FIG. 1 illustrates one embodiment of the present invention showing a three (3)-way multi-filament incandescent lamp.

FIG. 1 illustrates a three (3)-way incandescent lamp 10 in accordance with one embodiment of the present invention. The lamp 10 comprises a light-transmissive outer envelope 12 which is sealed and attached to an electrically conductive screw-in base 14.

The lamp 10 further comprises a minor filament 16 having a support member 18 located about its central portion and a major filament 20. The minor filament 16 may have a wattage rating in the range of from about 10 to 60, whereas, the major filament 20 may have a wattage rating in the range from about 70 to 200. The minor filament 16 can be a coiled-coil type having a turns-per-inch (TPI) characteristic in the range from about 50 to about 200, whereas, the major filament 20 can also be a coiled-coil type having a TPI characteristic in the range of about 25 to about 100. The minor filament 16 and the major filament 20 are supported within the outer envelope 12 by an improved mounting structure 22 shown in more detail in FIG. 2 and shown as removed from the lamp 10.

The mounting structure 22 has a stem 24 comprised of three-pillar shaped arrangements $24_A$, $24_B$, and $24_C$, and a flare portion $24_D$, all formed of glass or other electrical insulating material. The first $24_A$, the second $24_B$, and third $24_C$ pillar portions have respective first 26, second 28 and third 30 inner lead conductors or wires. The inner lead wire 26 is common to both the minor 16 and major 20 filaments and provides for electrical and mechanical or crimped connections for both filaments. For the embodiment shown in FIG. 2 and also FIG. 1, the inner lead wire 26 is longer than either inner lead wire 28 or inner lead wire 30.

The first $24_A$, second $24_B$, and third $24_C$ pillar portions also have respective first 32, second 34, and third 36 outer lead conductors or wires extending therethrough and connected to appropriate portions the metal screw 14 of FIG. 1 so as to provide the desired illumination for the three (3)-way lamp 10.

Before the sealing process of the stem 24 the support member 18 is inserted into and exits from an exhaust tube 38 at a small opening at the upper central portion of the stem 24. The sealing process of the stem 24 affixes the lower portion of the support member 18 to the confines of the stem 24. This sealing process also affixes the lower portion of the inner lead wires 26, 28 and 30 to the stem 24.

The outer lead wires 32, 34, and 36 may be selected to have particular characteristics determined by the desired modes A and B of operation which may be of the types described in U.S. patent application Ser. No. 607,838. Similarly, the inner lead wires 26, 28, and 30 are cylindrical and may each have a diameter in the range as described in U.S. patent application Ser. No. 607,838.

Further, the inner lead-in wires 26, 28, and 30 are comprised of a plurality of various bends some of which are similar to the various described bends disclosed in the previously mentioned U.S. Pat. No. 4,400,646. For example, the upper regions of the inner lead 26 and 28 may have, respectively, reverse bends $26_A$ and $28_A$ similar to the reverse bend 29 disclosed in U.S. Pat. No. 4,400,646 to which reference may be made for further details. The reverse bends $26_A$ and $28_A$ assist in providing a rigid support within the lamp 10 for the filaments 16 and 20.

The inner lead wires 26 and 28, respectively, have hooked portions and $28_B$ which $28_B$ provide for a hooked crimped connection of the major filament 20. Similarly, the inner lead wire 30 has a hooked portion $30_B$ for a hooked crimped connection to one end of minor filament 16. The other end of the minor filament 16 is connected by clamping to an indented portion $26_B$, commonly termed a "J hook," formed in the centeral region of the inner lead 26. The inner lead wire 26 is longer than the inner lead wire 30 and each have preselected diameters and distances that are selected relative to each other.

The uppermost crimped connection $26_B$ of inner lead 26 is located from the upper portion of the stem 24 by a first predetermined distance 40. The crimped connection $30_B$ of inner lead 30 is located from the upper portion of the stem 24 by a second predetermined distance 42. The reverse bend $26_A$ is also located from the upper portion of the stem 24 by the second predetermined distance 42.

Figure 2:
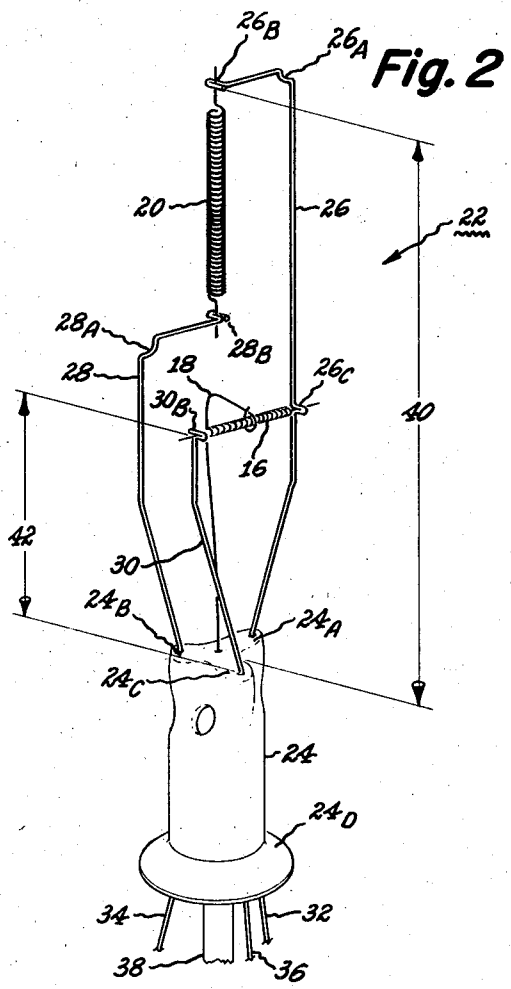
FIG. 2 shows an improved mounting structure in accordance with one embodiment of the present invention.

The mounting of the filaments shown in FIG. 2 arranges the major filament 20 in an axial manner and the minor filament 16 in a transverse manner. Such an arrangement is an improvement over the previously discussed mounting of U.S. patent application Ser. No. 607,838 primarily related to increasing the strength of the minor filament 16 to withstand shock. The increased strength is primarily achieved by selecting the first predetermined distance 40 and first diameter of inner lead wire 26 so as to proportionate to the second distance 42 and second diameter of the inner lead wire 30 in accordance with the following expression:

$$\text{second diameter} = \text{first diameter} \times \frac{\text{second distance}^{(a)}}{\text{first distance}} \qquad (1)$$

where the quantity (a) has a value in the range of about ½ to about 1.

These characteristics second diameter, first diameter, first distance 40 and second distance 42 primarily control or limit the movements of the filaments 16 and 20, particularly filament 16.

The expression (1) may have representative values given in Table 1.

TABLE 1

| First Diameter Wire 26 | Second Diameter Wire 30 | Second Distance 42 | First Distance 40 |
|---|---|---|---|
| 0.5 mm | 0.35 mm | 25 mm | 50 mm |
| 0.4 mm | 0.28 mm | 20 mm | 40 mm |
| 0.5 mm | 0.31 mm | 20 mm | 50 mm |
| 0.5 mm | 0.29 mm | 20 mm | 60 mm |

It is preferred that for a 30 watt minor filament the following ranges of values of Table 1 be selected:

First diameter from about 0.4 mm to about 0.5 mm;

Distance 42 from about 20 mm to 25 mm;

Distance 40 from about 40 mm to about 60 mm; and

Second diameter from about 0.25 mm to about 0.35 mm.

Figure 3:
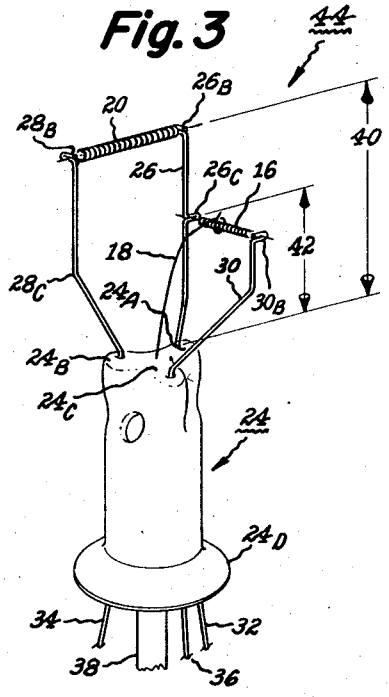
FIG. 3 shows a further improved mounting structure in accordance with another embodiment of the present invention.

A second embodiment having the features of the present invention is shown in FIG. 3 for a mounting arrangement 44. The mounting arrangement 44 of FIG. 3 has elements similar to that of mounting arrangement 22 of FIG. 2 and uses the same reference numbers where applicable for the elements previously described for FIG. 2. The mounting arrangement 44 is different than that of mounting arrangement 22 in that it rigidly disposes both the minor and major filaments in a transverse manner.

The inner lead wire 28 and the common inner lead wire 26 both have their uppermost clamp connection located at a substantially equal distance relative to the upper portion of the three-pillar stem 24. The inner lead wire 26 is longer than the inner lead wire 30 and each have preselected diameters and distances that are selected relative to each other.

The inner lead wire 26 of the mounting arrangement 44 has an indented or "J hook" portion $26_C$, at its central region, for capturing and providing the connection to one end of the minor filament 16 having its other end connected to inner lead wire 30 by way of hooked connection $30_B$. The inner lead wire 26 has the hooked connection $26_B$ connected to one end of the major filament 20 having its other end connected to inner lead wire 28 by way of hooked connection $28_B$. The connection $26_B$ is located from the upper portion of the stem 24 by the first predetermined distance 40 previously described with regard to FIG. 2. Similarly, the connection $30_B$ is located from the upper portion of the stem 24 by the second predetermined distance 42 previously described with regard to FIG. 2.

The inner lead wire 26 has the first distance 40 and a first diameter selected so as to be proportionate to the second distance 42 and the second diamter inner lead wire 30 in accordance with the previously given expression (1).

For the embodiment shown in FIG. 3, in addition to having the same length for lead wires 28 and 26 shown in FIG. 3 as the first distance 40, it is preferred that lead wire 28 and 26 have the same diameter, that being the second diameter. The selection of the parameter of the inner leads of expression (2) provides a rigid mounting of both filaments that is enhanced with regard to withstanding shock.

The parameters of expression (2) may have representative values given in Table 2.

TABLE 2

| First Diameter Wire 26 | Second Diameter Wire 30 | Second Distance 42 | First Distance 40 |
|---|---|---|---|
| 0.46 mm | 0.35 mm | 25 mm | 42 mm |
| 0.50 mm | 0.35 mm | 25 mm | 50 mm |
| 0.39 mm | 0.30 mm | 25 mm | 42 mm |

In the practice of the present invention, two three-way lamps of the kind shown at 10 in FIG. 1 and having respectively 15 and 30 watt minor filaments 16 were placed in the CC6 transverse configuration shown in FIG. 1. The lamps 10 were subjected to a drop test and exhibited a 50% decrease in breakage of the minor filament by comparison with those lamps not having the features of the present invention.

It should now be appreciated that the practice of the present invention provides for a structure having improved mounting of its minor filament and major filament particularly related to the ability of the minor and major filaments to withstand shock.

What we claim as new and desire to secure by Letters Patent of the United States is:

1. A multi-filament incandescent lamp adapted to operate at different levels of illumination comprising:

an outer envelope sealed and connected to an electrically conductive screw-in base;

a minor and a major filament;

a three-pillar stem portion for spatially disposing said minor and major filament within said outer envelope, said three-pillar stem portion having an inner and outer lead wires extending through each of the three-pillar portions with one end of each of said outer lead wires appropriately connected to said electrically conductive screw-in base effective to obtain said different levels of illumination, said inner lead wires each having a desired configuration, one of said inner lead wires being common to both of said minor and major filament and having at least two hooked bends for respective clamp connections to one end of each said minor and major filaments, the other two inner lead-in wires each having a hooked bend for a clamped connection to the other respective opposite ends of said minor and major filaments, at least said minor filament being mounted in a transverse manner, each of said transverse filaments being mounted by at least a first and a second of said inner lead wires, at least one of said first and second inner lead wires being shorter than the other, wherein;

said first lead wire has its uppermost crimped connection located at a first predetermined distance relative the upper portion of the three-pillar stem and a first diameter both selected so as to be proportional to the location of a second crimped connection located at a second predetermined distance relative the upper portion of the three-pillar stem and a second diameter both of said second inner lead wire in accordance with the following relationship:

$$\text{second diameter} = \text{first diameter} \times \frac{\text{second distance}}{\text{first distance}} \quad \text{(a)}$$

where the quantity (a) has a value in the range of about one-half ($\frac{1}{2}$) to about one (1).

2. A multi-filament incandescent lamp according to claim 1 wherein each of said minor and major filaments are of a coiled-coil type.

3. A multi-filament incandescent lamp according to claim 1 further comprising a support member having an upper portion positioned around said minor filament and a lower portion sealed in said three-pillar portion.

4. A multi-filament incandescent lamp according to claim 1 wherein said major filament is mounted in an axial manner and said minor filament is mounted in a transverse manner and further wherein;

(1) said first diameter has values in the range of about 0.4 mm to about 0.5 mm;

(2) said second diameter has values in the range of about 0.29 mm to about 0.35 mm;

(3) said second distance has values in the range of about 20 mm to about 25 mm; and (4) said first distance has values in the range of about 40 mm to about 60 mm.

5. A multi-filament incandescent lamp according to claim 1 wherein both of said minor and major filaments are mounted in a transverse manner and further wherein:

(1) said first diameter has values in the range of about 0.39 mm to about 0.50 mm;

(2) said second diameter has values in the range of about 0.30 mm to about 0.35 mm;

(3) said second distance has a value of about 25 mm, and (4) said first distance has values in the range of about 42 mm to about 50 mm.

6. A multi-filament incandescent lamp according to claim 5 wherein both lead wires clamped to said major filament are both selected to have said same first distance and said same first diameter.

* * * * *